US005630790A

United States Patent [19]

Ito

[11] Patent Number: 5,630,790

[45] Date of Patent: May 20, 1997

[54] MASSAGER OF ROLLER TYPE

[76] Inventor: Takakazu Ito, 1-866 Kami Higashiozone-cho, kita-ku, Nagoya, Japan

[21] Appl. No.: 383,722

[22] Filed: Feb. 3, 1995

[51] Int. Cl.[6] ..... A61H 7/00

[52] U.S. Cl. ..... 601/94; 601/102

[58] Field of Search ..... 601/93, 94, 97, 601/115, 116, 84, 86, 90, 92; 600/9

[56] References Cited

U.S. PATENT DOCUMENTS

| | | | |
|---|---|---|---|
| 3,374,784 | 3/1968 | Brent et al. | 601/94 |
| 4,422,449 | 12/1983 | Hamabe | 601/99 |
| 4,454,867 | 6/1984 | Swanson | 601/115 |
| 5,323,499 | 6/1994 | Chan | 600/9 |
| 5,487,723 | 1/1996 | Ito | 601/99 |

*Primary Examiner*—Sam Rimell
*Assistant Examiner*—Pamela Wingood
*Attorney, Agent, or Firm*—Emmanuel J. Lobato; Burns & Lobato, P.C.

[57] ABSTRACT

A driven massager of roller type for incorporation into a seat or backrest of a chair or into a mat as traveling massage unit. A traveling housing of the massage unit houses and carries drive and operating mechanisms for driving the traveling unit and operating a rotatable pair of elongate massage pressure rollers carried thereon disposed axially spaced in a common plane above the housing and driven alternatively in circular clockwise and counterclockwise motion while the traveling housing is stationary along a rectilinear path of travel or traveling thereon in two opposite directions on a pair of parallel gear racks laterally spaced defining the path of travel. The traveling housing is provided with driven paired gears on opposite sides for traveling on the gear racks. The massage pressure rollers are mounted on a support that provides for moving the rollers between two planes spaced above the level of the traveling housing for variably applying massage pressure to a user seated in the chair or reclining thereon or on a mat. The various circular motions and movements between the planes can be effected simultaneously or separately with the massage unit stationary or traveling.

3 Claims, 8 Drawing Sheets

MASSAGER OF ROLLER TYPE

BACKGROUND OF THE INVENTION

1. Field of the Invention

The present invention relates to a massager of the roller type adapted to massage back and/or hips of a user sitting down or upright on a chair or lying on a mat by rollers incorporated in the chair of mat so as to roll on the back and/or the hips, respectively, exerting appropriate pressure thereupon.

2. Description of the Prior Art

A massager of the roller type is well known which contains within back and/or seat of a chair or within a mat rollers so as to massage the back and/or the hips of a user.

However, with the massager of the prior art, the rollers are reciprocated in a single direction and a substantially limited area is massaged in a fixed direction. Consequently,it has been found that the affected part of user's body is often left insufficiently massaged.

SUMMARY OF THE INVENTION

It is a principal object of the invention to provide a traveling massage unit wherein a pair of massage pressure rollers are transported on a traveling housing which transports thereon the massage pressure rollers and encloses and mounts thereon drive and operating mechanisms for incorporation as a unit into the seat or backrest of a chair or a mat. A single variable speed reversible electric motor and the mechanisms transported in the housing provide for a multiplicity of modes of directional travel of the massage unit and modes of operation of the massage pressure rollers.

Provision is made for the mount of the massage pressure rollers to mount them coaxially spaced in a common plane above the top of the housing and being selectively driven alternatively in circular and clockwise motion while the traveling housing is stationary along a rectilinear path of travel or traveling in either of opposite directions.

The pair of massage pressure rollers extend away from each other transversely of the rectilinear path of travel for massaging in a large area and the rollers are movable reciprocably between two planes spaced above the top of the housing for applying a variable massage pressure in the massage area thereof.

DESCRIPTION OF THE PREFERRED EMBODIMENT

The invention will be more readily understood from the following detailed description of a specific embodiment in reference with the accompanying drawings.

Figure 1:
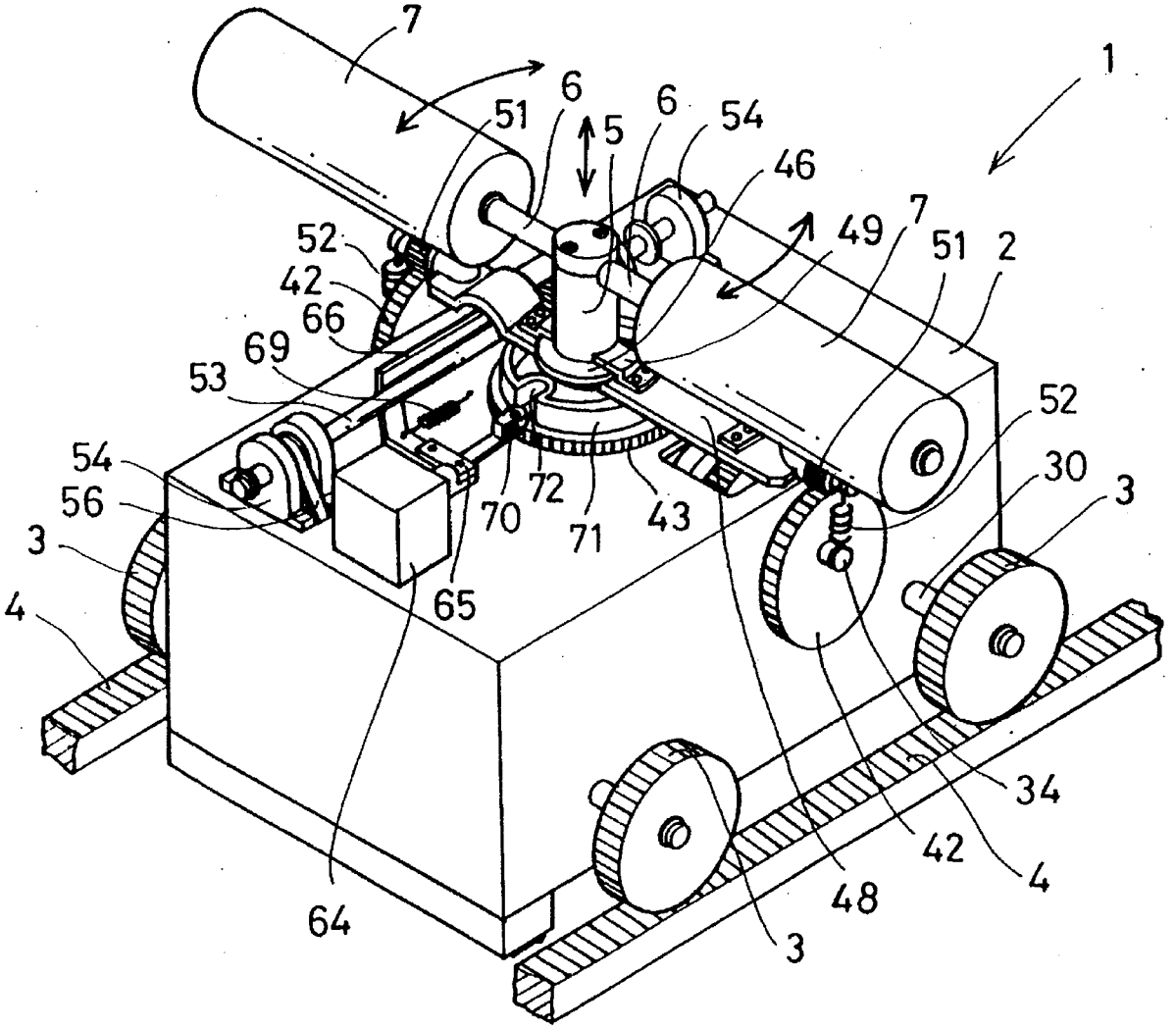
FIG. 1 is a perspective view exemplarily illustrating the massager of the invention.

Referring to FIG. 1, reference numeral 1 designates a basic traveling massage unit comprising a box or housing 2, travelling gears 3 carried by the box 2 on both sides thereof adapted to be engaged with associated rail-like racks 4 so that the box 2 reciprocates on the racks 4 as the travelling gears 3 are rotated in alternate directions and stopped at a desired position as the travelling gears 3 are controllably stopped, elongate massage pressure rollers 7 rotatably supported by respective arms 6 laterally extending from opposite sides of a support 5 which is, in turn, supported on a top of the box 2 at a center thereof so that the rollers 7 simultaneously present up-and-down motion and one-directional circular motion as the support 5 is put in the same motions. With such basic massaging mechanism 1 incorporated in chair or mat so that the rollers 7 may bear against the back and/or the hips of user, the rollers 7 roll on the back and/or the hips as they describe a circle in one direction while moving up and down and thereby massage the above-mentioned regions of the user's body.

Figure 2:
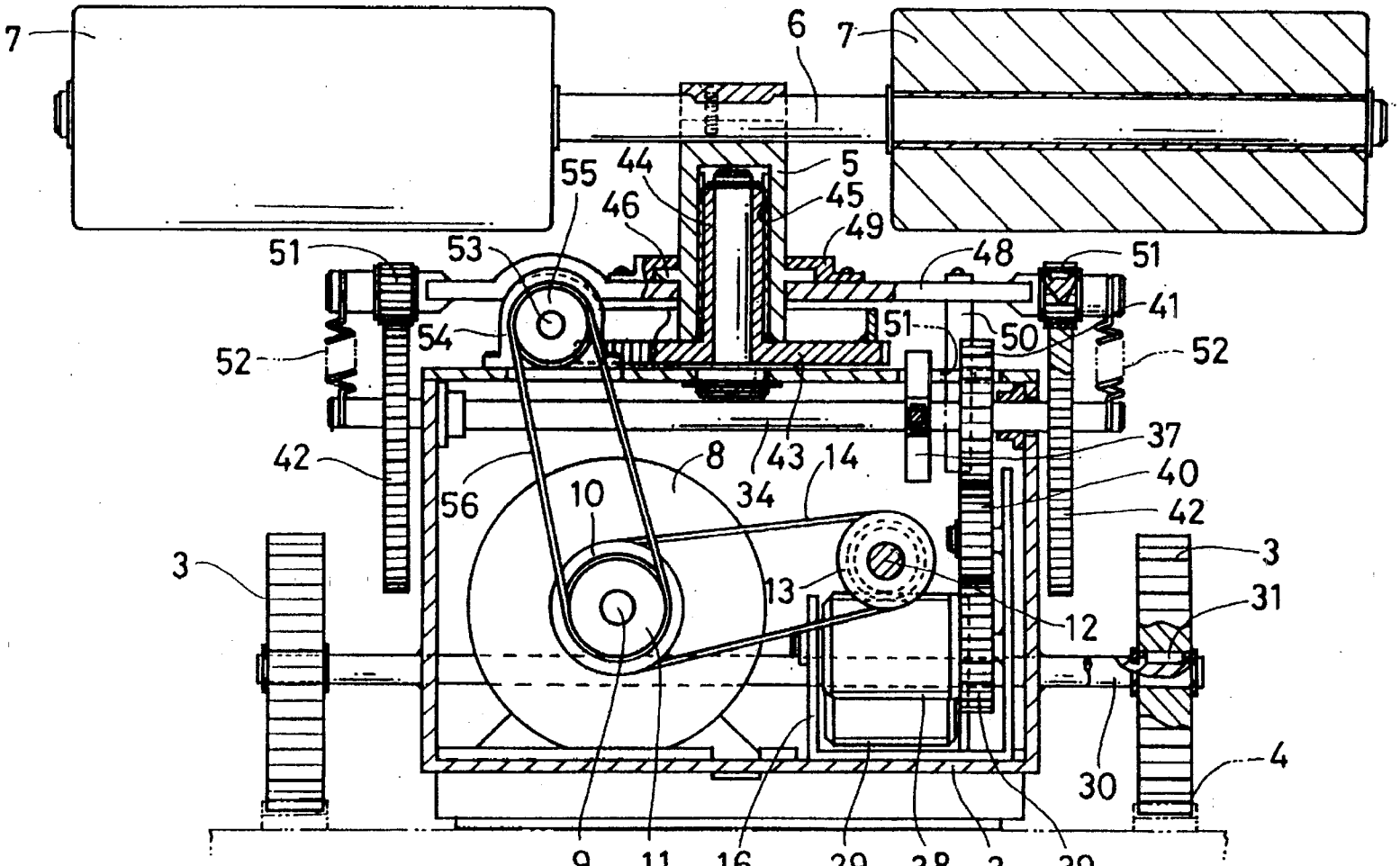
FIG. 2 is a sectional front view of this massager.

Referring to FIG. 2 illustrating the invention in a sectional front view, the box 2 contains therein a speed variable reversible motor 8 having an output shaft 9 to which a fist pulley 10 as well as a second pulley 11 are fixed and a belt 14 is disposed about the first pulley 10 and a pulley 13 fixed to a first shaft 12 extending across the interior of the box 2.

Figure 3:
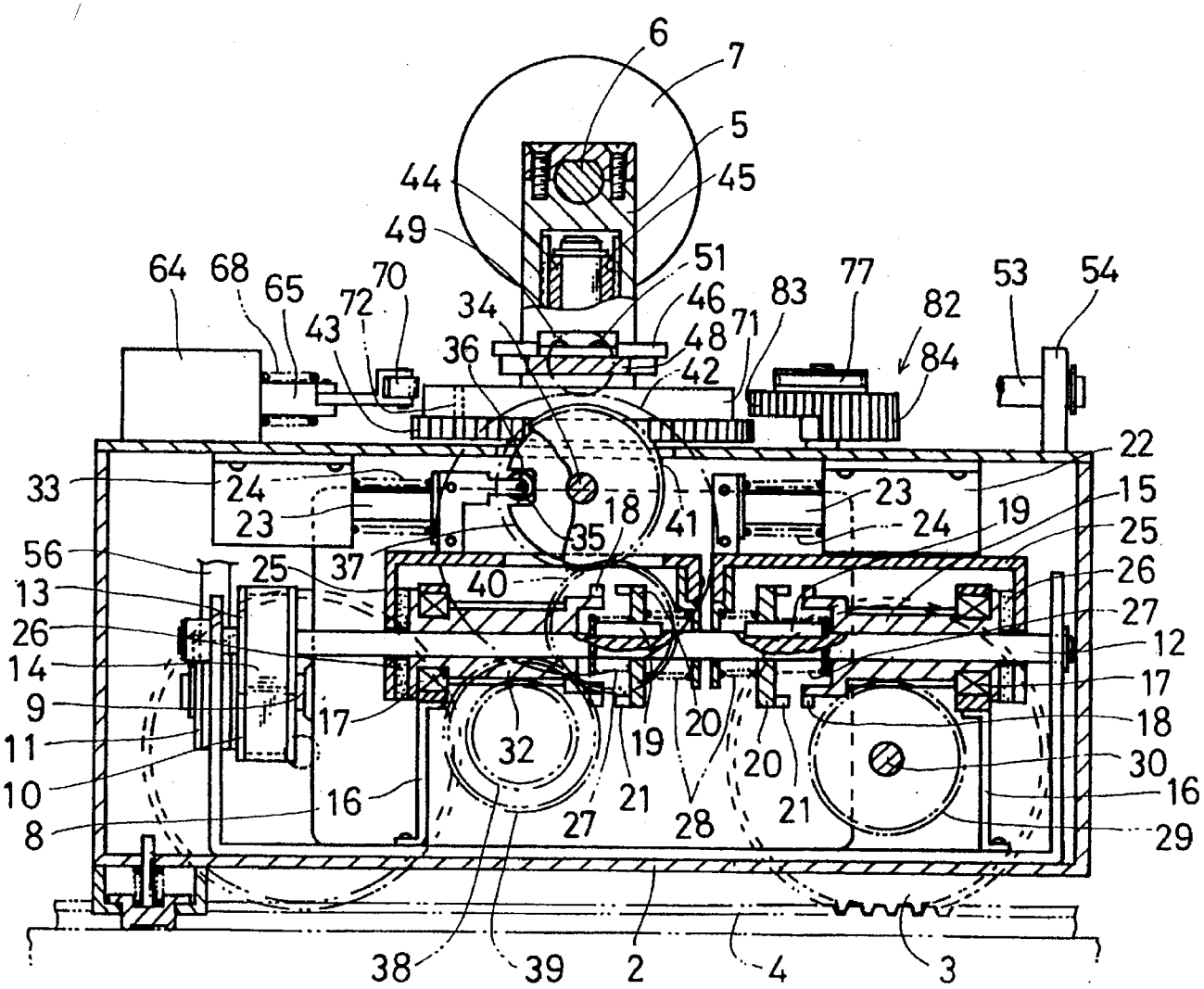
FIG. 3 is a sectional side view of the massager with a first solenoid 22 deenergized.
Figure 4:
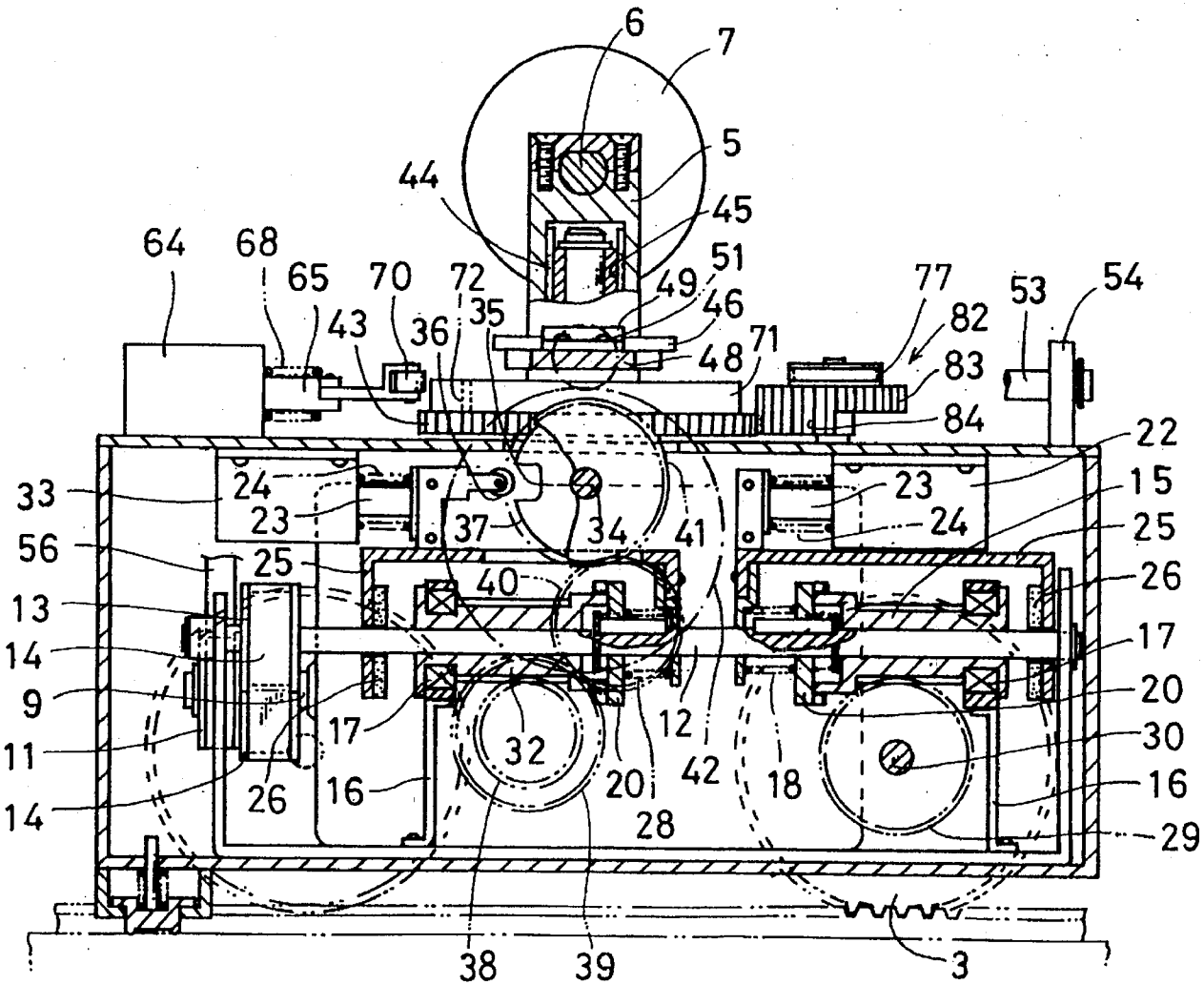
FIG. 4 is a view similar to FIG. 3 but with the first solenoid 22 energized.

Referring to FIGS. 3 and 4 illustrating the invention in a sectional side view, there is provided around the first shaft 12 at the right side thereof as viewed in FIGS. 3 and 4 a first worm gear 15 formed with a clutch claw 18, which is supported by a bearing 17 of a support 16 so as to be rotatable relative to the first shaft 12. Opposed to the left end of the first worm gear 15, a clutch 20 having a claw 21 is mounted by a key 19 on the first shaft 12 so as to be axially slidable but not rotatable relative to the first shaft 12.

Above the first worm gear 15, the ceiling of the box 2 carries a first solenoid 22 having a plunger 23 normally thrusted out leftward under biasing effect of a spring 24 and the plunger 23 is provided at an end with an arm 25 of inverted U-shape straddling the first worm gear 15 as well as the clutch 20. When the first solenoid 22 is deenergized, the right end of the arm 25 urges a brake disc 26 under the biasing effect of the spring 24 to brake the first worm gear 15 and the clutch 20 is held under a combined biasing effect of a soft spring 27 and a hard spring 28 to be spaced from the first worm gear 15, as will be seen in FIG. 3.

A worm wheel 29 engaged with the first worm gear 15 having an axle 30 fixedly extending through the center thereof, said axle 30 further extending outward from the opposite side walls of the box 2 and the respective travelling gears 3 are fixed by keys 31 on the opposite ends of the axle 30.

When the first solenoid 22 is energized during rotation of the reversible motor 8, the plunger 23 retracts and the arm 25 moves rightward as will be seen in FIG. 4. The clutch 20 slides on the key 19 under the biasing effect of the hard spring 28 as the brake disc 26 is spaced from the first worm gear 15, so that the claw 21 is engaged with the clutch claw 18 to rotate the first worm gear 15, thus the travelling gears 3 rotate together with the worm wheel 29 engaged with the first worm gear 15 and travel on the respective racks 4.

A manual switch (not shown) or a limit switch provided at each end of the course of travel may be operated and thereby the direction of rotation of the reversible motor 8 may be reversed to switch the direction of travel and a revolving speed of the reversible motor 8 may be controllably varied to adjust the speed of travel.

As the first solenoid 22 is deenergized, it restores the position shown by FIG. 3 at which the claw 21 of the clutch 20 is disengaged from the clutch claw 18 and the brake disc 26 is urged against the first worm gear 15 to brake it and thereby to brake the travelling gears 3.

Similarly, there is provided around the first shaft 12 at the left side thereof as viewed in FIGS. 3 and 4 a second worm gear 32 formed with a clutch claw 18, which is supported by a bearing 17 of a support 16 so as to be rotatable relative to the first shaft 12. Opposed to the right end of the second worm gear 32, a clutch 20 having a claw 21 is mounted by a key 19 on the first shaft 12 so as to be axially slidable but not rotatable relative to the first shaft 12.

Above the second worm shaft 32, the ceiling of the box 2 carries a second solenoid 33 having a plunger 23 normally thrust out rightward under biasing effect of a spring 24 and the plunger 23 is provided at an end with an arm of inverted U-shape straddling the second worm gear 32 as well as the clutch 20. When the second solenoid 33 is deenergized, the left end of the arm 25 urges a brake disc 26 under biasing effect of the spring 24 to brake the second worm gear 32, the clutch 20 is held under a combined biasing effect of a soft spring 27 and a hard spring 28 to be spaced from the second worm gear 32 and a roller 36 rotatably supported by the forward end of the plunger 23 is received in a notch formed in a disc 37 which is fixed on a second shaft 34 extending across the interior of the box 2.

A worm wheel 38 is engaged with the second worm gear 32, and a gear 39 coaxially fixed to the worm wheel 38 is engaged with a gear 40 which is, in turn, engaged with a gear 41 fixedly mounted on the second shaft 34. Opposite ends of this second shaft 34 extend outward through the box 2 carry thereon eccentric gears 42, respectively.

Figure 5:
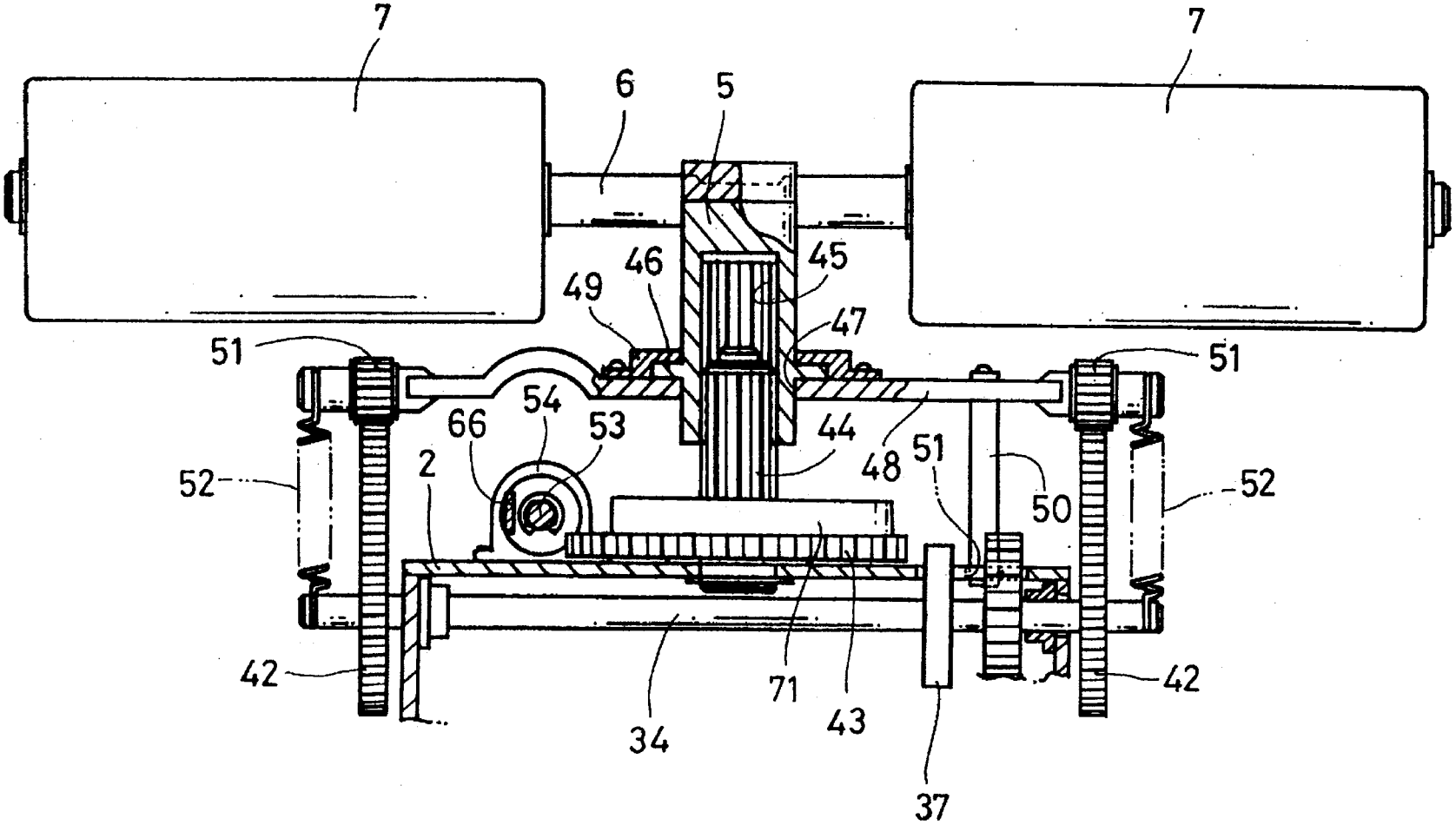
FIG. 5 is a sectional front view illustrating, in an enlarged scale, a mechanism for up-and-down motion of rollers 7.

As shown in an enlarged scale by FIG. 5, a gear 43 centrally provided with a spline shaft 44 disposed integrally thereon is rotatably supported on the top of the box 2 and the support 5 has female splines 45 adapted to be engaged over the spline shaft 44 so that the support 5 may be slidably moved up and down. The support 5 is formed around its outer periphery with a flange 46. There is provided a supporting arm 48 centrally formed with an opening 47 for loosely receiving the support 5 and having a pair of pressure plates 49 fixed on its top surface for loosely holding the flange 46. To prevent the supporting arm 48 from oscillating, a holder plate 50 is inserted into a guide hole 51 formed in the top wall of the box 2.

Pinions 51 are rotatably mounted on opposite ends of the arm 48, respectively, so as to be engaged with the respective eccentric gears 42 and tension springs 52 are suspended between the respective ends of the arm 48 and the associated ends of the second shaft 34 in order to bias the pinions 51 to be in engagement with the respective eccentric gears 42.

When the second solenoid 33 is energized during rotation of the reversible motor 8, the plunger 23 and therefore the roller 36 retract away from the notch 35 of the disc 37, the arm 25 moves leftward, the brake disc 26 is disengaged from the second worm gear 32, the clutch 20 slides along the key 19 under biasing effect of the hard spring 28 so as to engage the claw 21 with the clutch claw 18. The frequency in rotation of the second worm gear 32, and rotation of the worm wheel 38 being engaged with the second worm gear 32 causes the gears 39, 40 and 41 to rotate the eccentric gears 42 around the second shaft 34, as best seen in FIG. 4.

Thereupon, engagement between the eccentric gears 42 and the pinions 51 causes the arm 48 to be moved up and down together with the support 5 and causes also the rollers 7 to be moved up and down.

Up-and-down motion of the rollers 7 is terminated as follows: Deenergization of the second solenoid 33 causes the plunger 23 to be advanced first until the roller 36 rolls on the periphery of the disc 37 and then further advanced until the roller 36 is received in the notch 35, whereupon the arm 25 moves rightward until the clutch 20 is let out. Consequently, the brake disc 26 brakes the second worm gear 32 and thereby terminates up-and-down motion of the rollers 7.

At this moment, the rollers 7 are necessarily located at their lowermost positions at which the rollers 7 can easily move, since the roller 36 has been received in the notch 35 of the disc 37.

The Frequency at which the rollers 7 move up and down can be varied by adjusting the revolving speed of the reversible motor 8.

On the top of the box 2, a third shaft 53 is rotatably supported by bearings 54 and a belt 56 is disposed about a pulley 55 mounted in an axially slidable but not rotatable manner by a key 57 on and relative to the third shaft 53 and the second pulley 11 fixed to the output shaft 9 of the reversible motor 8.

A third worm gear 58 formed on its right end with a clutch claw 59 is supported by the bearings 54 in axially slidable and rotatable manner on and relative to the third shaft 53 and a clutch 61 is slidably mounted by a key 60 on this third shaft 53 so that the clutch 61 is held to be spaced from the third worm gear 58 under a combined biasing effect of the hard spring 28 suspended between the clutch 61 and a first ring 62 and the soft spring 27 suspended between the clutch 61 and the third worm gear 58.

A second ring 63 is fixed on the third shaft 53 on the left side of the middle one of the bearings 54.

A third solenoid 64 is provided on the top of the box 2 and a forward end of an arm 66 connected to a plunger 65 associated with the third solenoid 64 extend rightward slightly beyond the second ring 63. A brake disc 67 is welded to the forward end surface of the arm 66.

The plunger 65 is biased by a combined effect of a compression spring 68 and a tension spring 69 to be thrusted out and a roller 70 rollably supported on the forward end of the plunger 65 is opposed to an annular wall 71 provided on the top of the gear 43. The annular wall 71 is formed with a notch 72.

A worm wheel 73 is engaged with the third worm gear 58 and a belt 77 is draped about a pulley 74 coaxially fixed to the worm wheel 73 and a pulley 78 coaxially fixed to a first gear 79 which is in engagement with a second gear 82.

Figure 9:
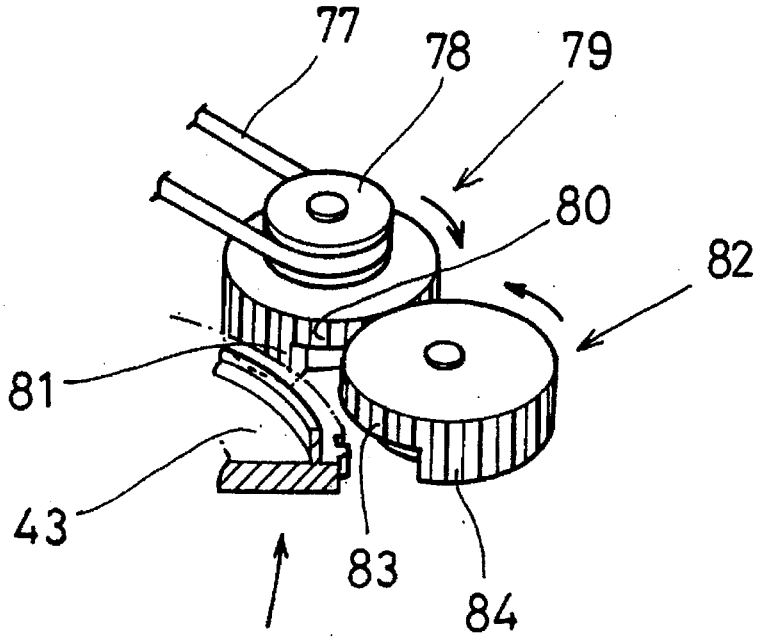
FIG. 9 is a perspective view illustrating a state in which the first gear 79 is engaged with a gear 43.
Figure 8:
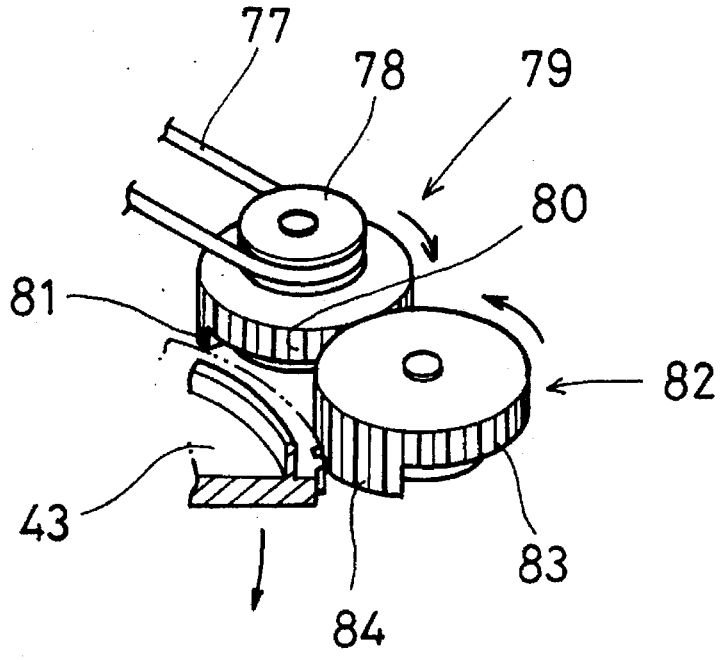
FIG. 8 is a perspective view illustrating a state in which a second gear 82 is engaged with a gear 43.

As shown by FIGS. 8 and 9, the first gear 79 comprises upper full-circumferential gear section 80 and lower semicircumferential gear section 81. Similarly, the second gear 82 comprises upper full-circumferential gear section 83 and lower semicircumferential gear section 84. The full-circumferential gear sections 80, 83 of the first and second gears 79, 82 are normally in mutual engagement and the first and second gears 79, 82 are adapted to be rotated in mutually opposite directions.

Both the first gear 79 and the second gear 82 are dimensioned to be half in their sizes with respect to the gear 43. As shown by FIGS. 7 and 9, the semicircumferential gear section 84 of the second gear 82 is out of engagement with the gear 43 when the semicircumferential gear section 81 of the first gear 79 is in engagement with the gear 43 and, as shown by FIGS. 6 and 8, the semicircumferential gear section 81 of the first gear 79 is out of engagement with the gear 43 when the semicircumferential gear section 84 of the second gear 82 is in engagement with the gear 43.

Accordingly, the semicircumferential gear section 81 of the first gear 79 comes in engagement with the gear 43 which is then rotated by 90° clockwise as viewed in FIG. 7 as the worm wheel 73 is rotated in the direction as indicated by an arrow in FIG. 7. Thereupon, the semicircumferential gear section 81 of the first gear 79 is disengaged from the gear 43 and now the semicircumferential gear section 84 of the second gear 82 comes in engagement with the gear 43, as shown by FIG. 8, and the gear 43 is rotated by 90° counterclockwise as viewed in FIG. 7. In this manner, the gear 43 repeatedly rotates in alternate directions.

When the third solenoid 64 is energized during rotation of the reversible motor 8, the arm 66 moves leftward together with the plunger 65 and the third shaft 53 also moves leftward, as best seen in FIG. 7, whereupon the brake disc 67 is disengaged from the third worm gear 58, simultaneously the clutch 61 is biased leftward by the hard spring 28 to be engaged with the clutch claw 59 of the third worm gear 58 and the third worm gear 58 is rotated together with the third shaft 53. This rotation is transmitted by the worm wheel 73, the pulley 74, the belt 77, the pulley 78 and the first gear 79 or the second gear 82 to the gear 43 which, in turn, rotates by 90° in alternate directions. In operative association with the gear 43, the spline shaft 44 also rotates by 90° in alternate directions together with the support 5 having the female splines 45 in engagement therewith. The support 5 swings with the flange 46 loosely held between the supporting arm 48 and the pressure plates 49 and the pressure rollers 7 more around the support 5 by 90° in alternate directions.

Figure 6:
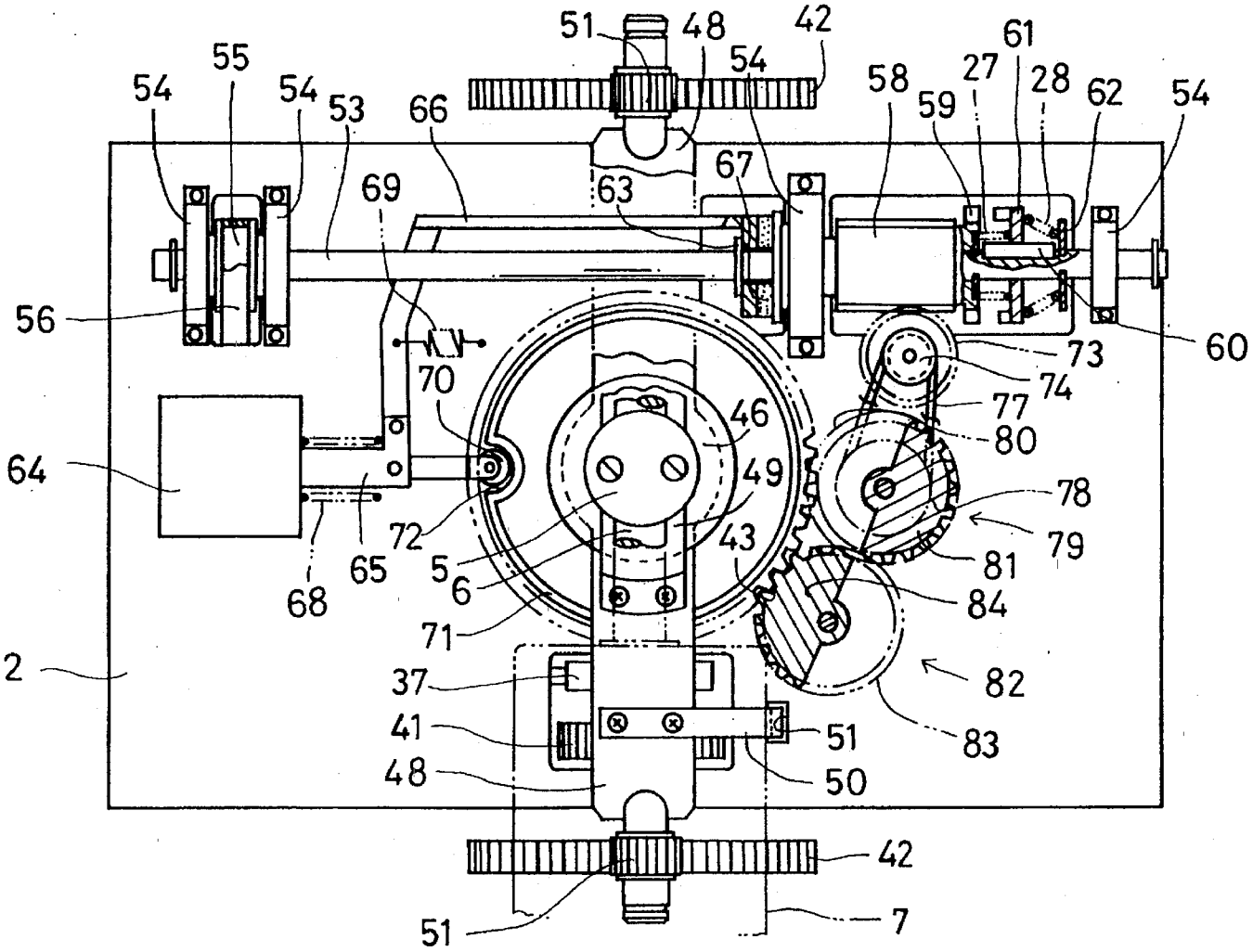
FIG. 6 is a plan view illustrating, as partially broken away, the massager with a third solenoid 64 deenergized.
Figure 7:
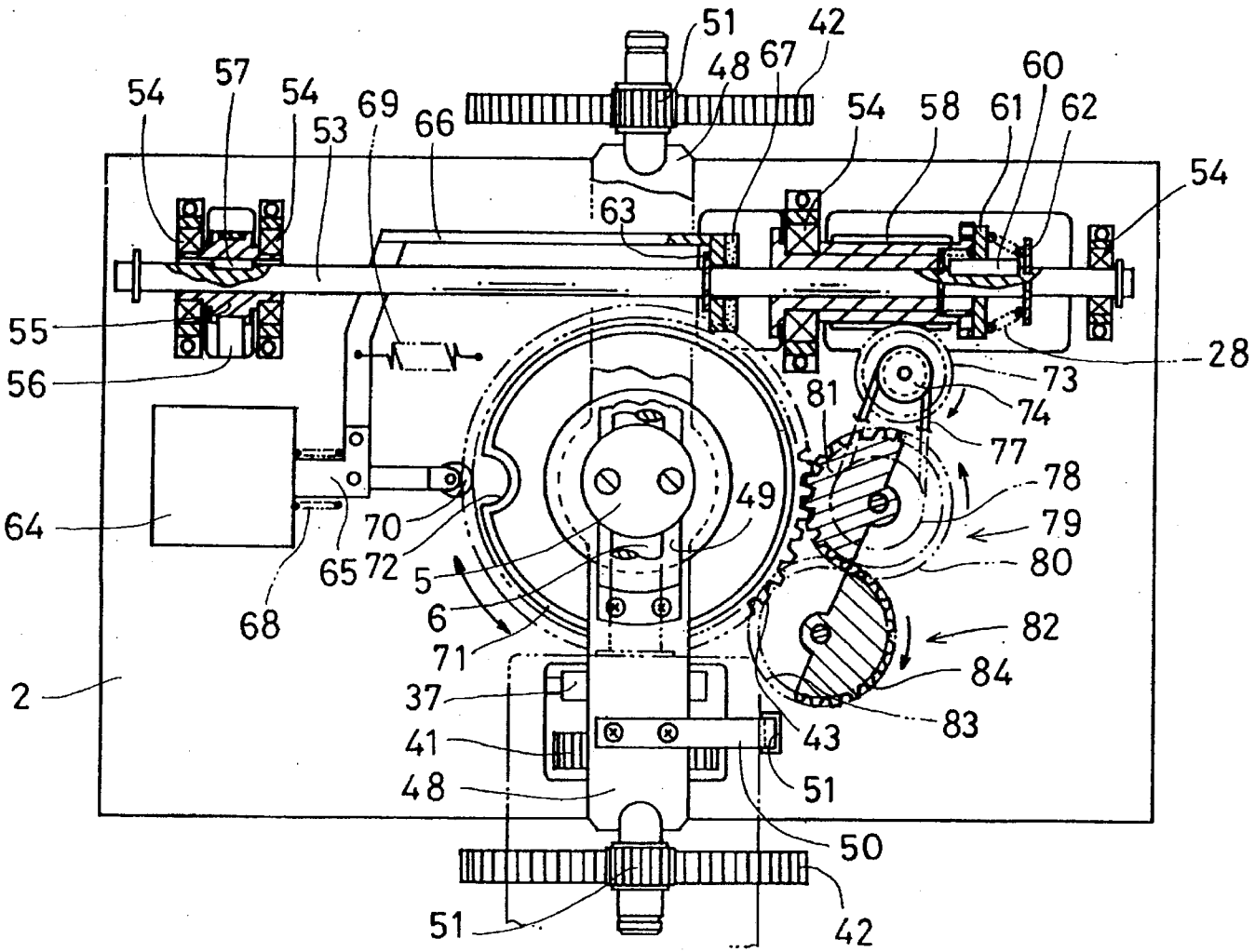
FIG. 7 is a view similar to FIG. 6 but with a third solenoid 64 energized.

When the third solenoid 64 is deenergized, the plunger 65 is advanced first until the roller 70 rolls on the annular wall 71 and then until the roller 70 is received in the notch 72, whereupon the plunger 65 is further advanced so as to move the third shaft 53 rightward, as best seen in FIG. 6. The clutch 61 is disengaged from the third worm gear 58 as the brake disc 67 bears against the third worm gear 58, and rotation of the third worm gear 58 and therefore the circular motion of the rollers 7 is terminated.

Now a common axis of the rollers 7 is orthogonal to the direction in which the box 2 travels since the roller 70 is in engagement with the notch 72 of the annular wall 71. Namely, the rollers 7 roll on the surface to be massaged with their common axis being orthogonal to the direction in which the box 2 travels.

As will be apparent from the foregoing description, this embodiment is so arranged that the first solenoid 22, the second solenoid 33 and the third solenoid 64 may be selectively energized or deenergized to obtain rectilinear reciprocating motion, up-and-down motion and circular motion of the rollers required to massage the affected part, separately or in operative association with one another.

It should be understood that the rollers 7 are preferably made of suitable magnetic material to facilitate blood circulation in the affected part.

What is claimed is:

1. A massager of roller type for incorporation into a seat or backrest of a chair or a mat comprising:

a traveling massage unit comprising a traveling housing enclosing a drive and operating mechanisms assembly for incorporation as a unit into said seat or backrest of a chair or said mat;

a pair of parallel gear racks laterally spaced for defining a rectilinear travel path for said massage unit;

said traveling massage unit having driven gears on two opposite sides of said housing, each pair of gears engaging a respective gear rack for transporting said massage unit traveling housing reciprocably alternatively in opposite directions along said travel path;

a pair of elongate massage pressure rollers mounted on said massage unit externally of said traveling housing disposed in a common plane above a top level of said housing coaxially spaced apart extending in opposite directions transversely of said travel path for travel along said travel path;

means coupled to said mechanisms of said assembly for mounting said elongate massage pressure rollers on said housing selectively driven for driving the massage pressure rollers alternatively in circular clockwise and counterclockwise motion when the traveling housing is stationary and traveling for massaging a user of said massage; and said means coupled to said mechanisms of said assembly for mounting said elongate pressure rollers selectively driven comprises means for reciprocably moving the massage pressure rollers jointly repetitively between said common plane upwardly relative to said housing to a second plane upwardly of said common plane for variable applying massage pressure to body parts of said user during said circular clockwise and counterclockwise motion.

2. A massage according to claim 1, in which said assembly comprises a single, reversible, variable speed electric drive motor in said traveling housing.

3. A massage according to claim 1, in which said massage pressure rollers are made of a magnetic material.

* * * * *